United States Patent [19]

Campbell

[11] Patent Number: 4,709,838

[45] Date of Patent: Dec. 1, 1987

[54] MULTIPLE PURPOSE HANGER

[76] Inventor: Frank P. Campbell, 11853 W. 71st Ave., Arvada, Colo. 80004

[21] Appl. No.: 922,723

[22] Filed: Oct. 24, 1986

[51] Int. Cl.[4] ..... A47G 25/34

[52] U.S. Cl. ..... 223/85; 223/DIG. 1; 223/DIG. 4; 211/115; 248/340; 24/625; 24/662; D6/315

[58] Field of Search ..... 223/DIG. 1, DIG. 4, 223/85, 89, 92, 94; 211/113, 115, 118; 294/86.19; 248/290, 340; 24/265 H, 625, 662, 346; D6/315, 317, 328; 206/292

[56] References Cited

U.S. PATENT DOCUMENTS

| | | | |
|---|---|---|---|
| D. 93,143 | 8/1934 | Spragg | 223/DIG. 1 |
| D. 190,608 | 6/1961 | Forrester | 223/85 X |
| D. 211,795 | 7/1968 | Wooten | D6/317 |
| D. 280,049 | 8/1985 | Benedict | D6/328 |
| 1,691,123 | 11/1928 | Pajeau | 211/113 |
| 3,551,963 | 1/1971 | Mosher, Jr. et al. | 24/662 X |
| 3,963,154 | 6/1976 | Schwartz et al. | 223/85 |
| 4,074,838 | 2/1978 | Blasnik et al. | 223/85 |
| 4,187,967 | 2/1980 | Garrison | 223/92 |
| 4,266,677 | 5/1981 | Dewsnap | 211/113 X |

FOREIGN PATENT DOCUMENTS

| | | | |
|---|---|---|---|
| 911776 | 5/1954 | Fed. Rep. of Germany | 24/625 |
| 526198 | 5/1955 | Italy | 223/85 |
| 227004 | 1/1925 | United Kingdom | 211/113 |

*Primary Examiner*—Andrew M. Falik
*Attorney, Agent, or Firm*—Bruce G. Klaas

[57] ABSTRACT

Apparatus for hanging articles of clothing or the like in a clothes closet or the like by suspension from a hanger rod or the like comprising an elongated vertically extending article hanging means having a plurality of vertically spaced oppositely facing hook portions and being made of one piece of molded plastic material for supporting the articles of clothing or the like; a support means made of one piece of molded plastic material and having a hook portion for mounting on a hanger rod or the like; and swivel means for rotatably connecting the elongated vertically extending article hanging means to the support means.

11 Claims, 12 Drawing Figures

22
20
34
26
36
37

22
20
34
26
37
36

22
55
28

52
53

37
39
38
36
26

58
56

59A
26
9
9
59C
59B 59B
58
59C

MULTIPLE PURPOSE HANGER

This invention relates to apparatus for hanging articles of clothing and accessories or the like in a clothes closet and, more particularly, to a multiple purpose hanger apparatus for mounting on a closet rod or the like.

My prior U.S. Pat. Nos. D. 277,349 and 4,518,089, disclose apparatus for expanding the storage capacity of a conventional clothes closet. The present invention provides additional apparatus for expanding the storage capacity of a conventional clothes closet and may be used in conjunction with my prior patented apparatus or by itself. The present invention relates to low cost durable multiple-function apparatus which is particularly suitable for hanging accessory-type clothing and jewelry articles such as ties, belts, scarves, necklaces, etc. from a closet rod, hook or whatever. The apparatus is constructed and arranged to provide a multiplicity of hanger hooks on a single piece of molded plastic material which may be twisted or turned in a hanging position to facilitate access to articles hung from a plurality of oppositely facing hook portions. In addition, the apparatus is constructed and arranged in a manner which provides good balance while utilizing a minimum number of parts capable of being easily assembled by the user without requiring any expertise or tools so that the apparatus may be shipped, stored and sold in a disassembled condition. Other objects and advantages of the invention are shown and disclosed by the drawings and the following detailed description of the invention.

DETAILED DESCRIPTION OF THE INVENTION

Figure 1:
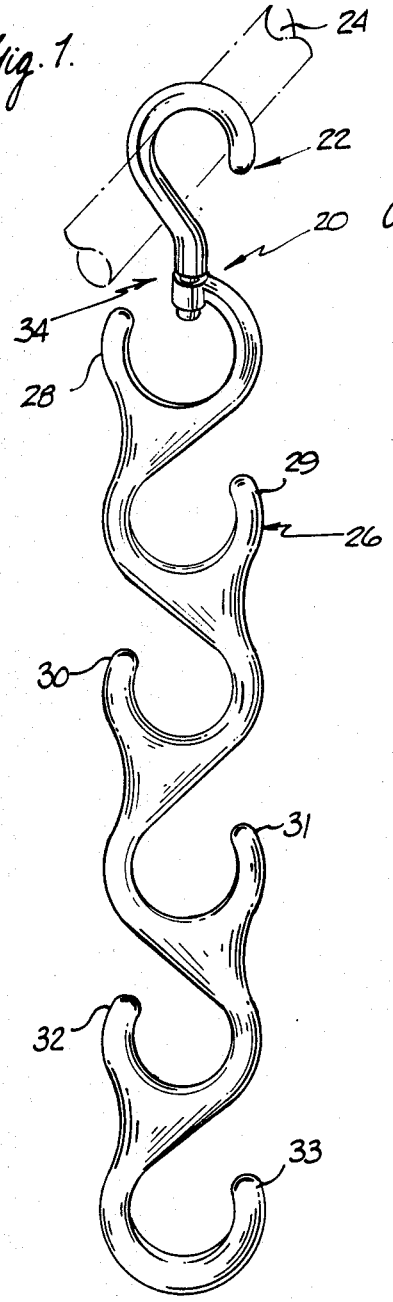
FIG. 1 is a perspective view of the multiple purpose hanger apparatus mounted on a conventional clothes rod in a clothes closet.

In general, the hanger apparatus 20 of the present invention comprises a hook type support means 22 for mounting the hanger apparatus on a support means 24, such as a clothes closet hanger rod member; an elongated article hanging means 26 with a central vertical longitudinal axis 27 and having a plurality of equally vertically spaced hook means portions 28, 29, 30, 31, 32, 33 for supporting articles of clothing such as belts, neckties, scarves, jewelry or the like; and a swivel connecting means 34 between the attachment means 22 and the article hanging means 26. The hanger apparatus has generally parallel coplanar side and edge surfaces 36, 37, 38, and 39.

Figure 2:
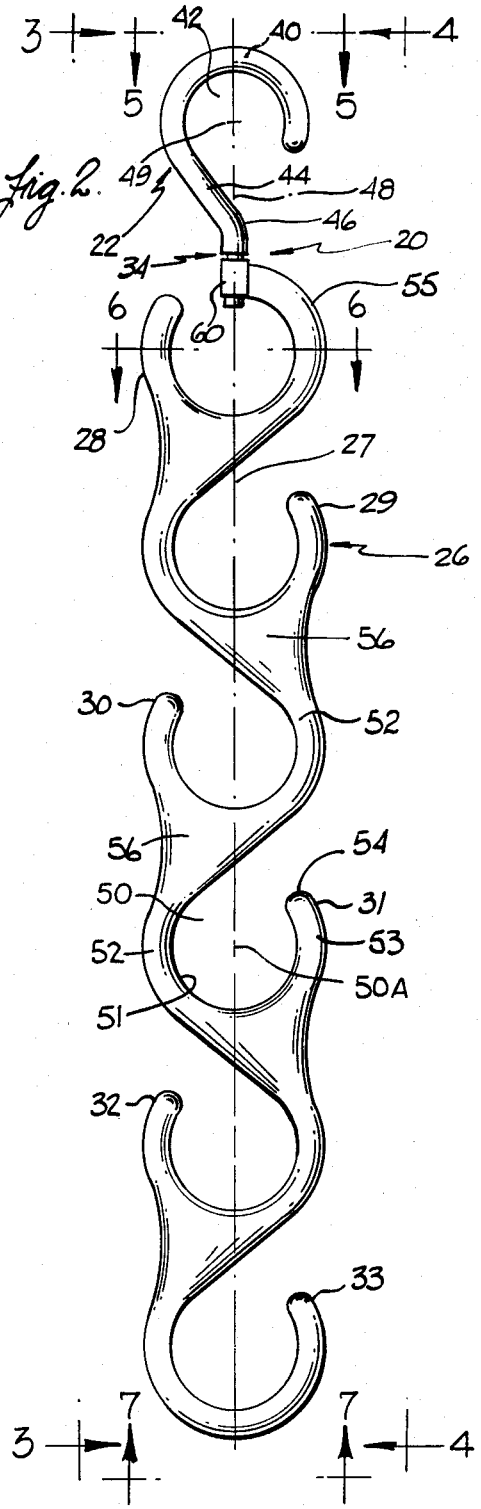
FIG. 2 is a front side view of the hanger apparatus.
Figure 3:
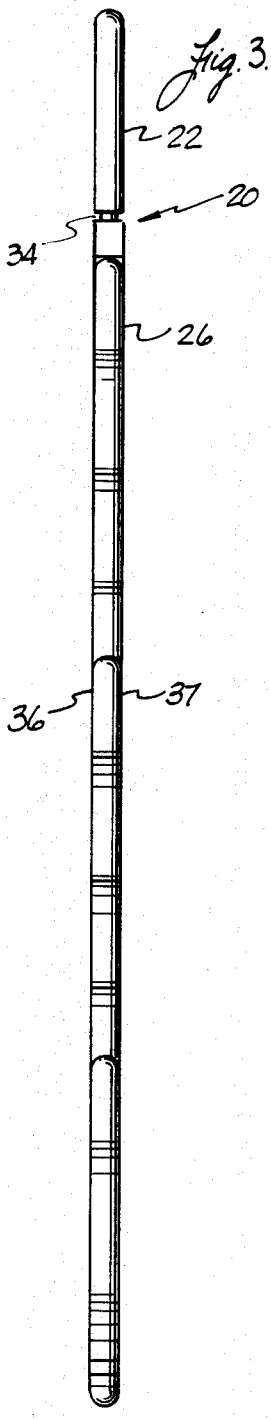
FIG. 3 is a left side view of the hanger apparatus of FIG. 2.
Figure 4:
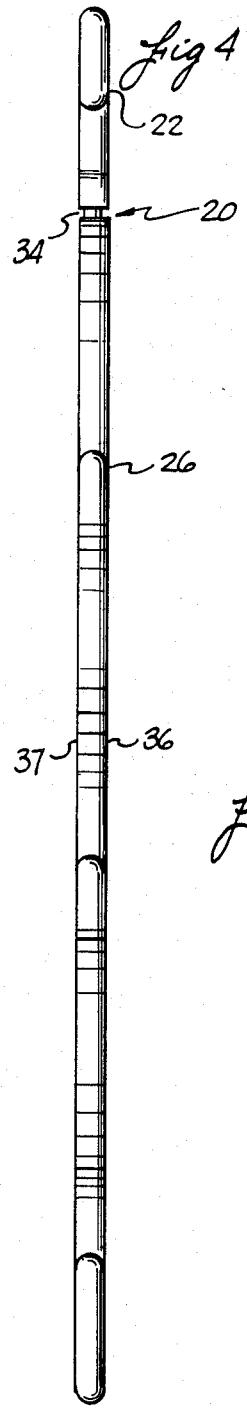
FIG. 4 is a right side view of the hanger apparatus of FIG. 2.
Figure 5:
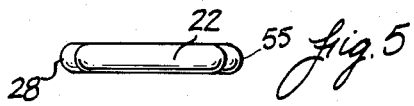
FIG. 5 is a top side view of the hanger apparatus of FIG. 2.
Figure 6:
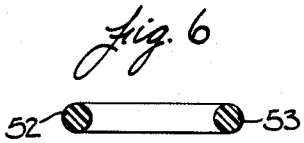
FIG. 6 is a cross-sectional view taken along line 6—6 in FIG. 2.
Figure 7:
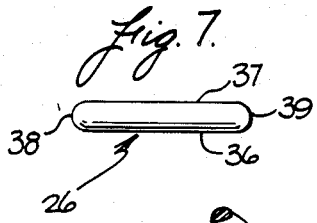
FIG. 7 is a bottom end view of the hanger apparatus of FIG. 2.
Figure 10:
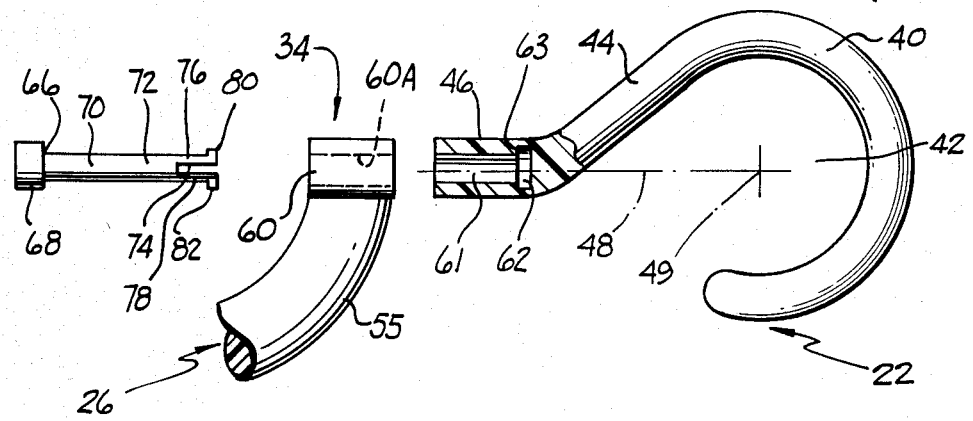
FIG. 10 is an enlarged exploded view, partly in section, of one embodiment of the swivel portion of the hanger apparatus.

The support means 22, FIGS. 2, 7, 10, is preferably made of one piece of molded plastic material of circular cross-section. A rounded upper portion 40 defines a generally semi-circular opening 42 and is connected to a downwardly inclined connecting portion 44 which terminates in a downwardly extending straight lower end portion 46 having a central vertical axis 48 generally intersecting the center 49 of the semi-circular opening 42 and being coaxial with the longitudinal axis 27 of hanging means 26.

Figure 8:
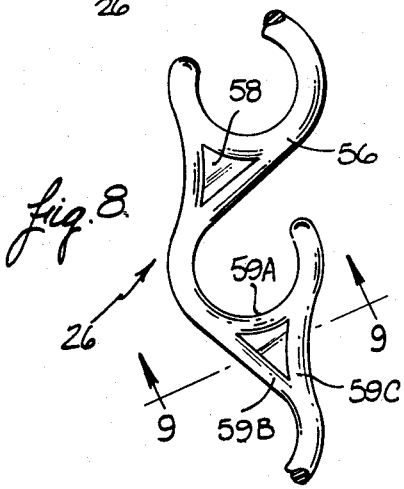
FIG. 8 is a partial front view of an alternate embodiment of the hanger portion.
Figure 9:
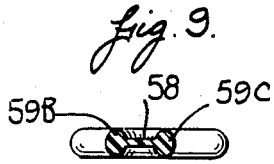
FIG. 9 is a cross-sectional view of the hanger portion shown in FIG. 8.

The article hanging means 26 is made of one piece of molded plastic material. Each of the hook portions 28–33 has a generally semi-circular upwardly facing opening 50 defined by a curved surface 51 extending along a connecting portion 52 of circular cross-section and a hook portion 53 of circular cross-section having a rounded terminal portion 54 spaced from the associated connecting portion 52 by an upwardly outwardly inclined passage therebetween. Each connecting portion, other than the uppermost hook means connecting portion 55, comprises a generally triangular shape upper portion 56 integral with connecting portion 52. In the embodiment of FIGS. 8 & 9, the triangular shape upper connecting portions 56 have a triangular shape indented central web portion 58 extending between circular side portions 59A, 59B, 59C.

Figure 11:
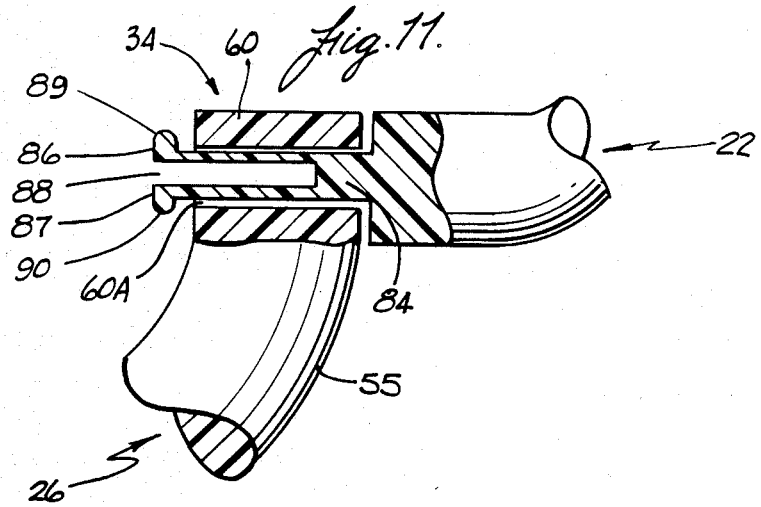
FIG. 11 is an enlarged partial cross-sectional view of an alternate embodiment of the swivel portion.
Figure 12:
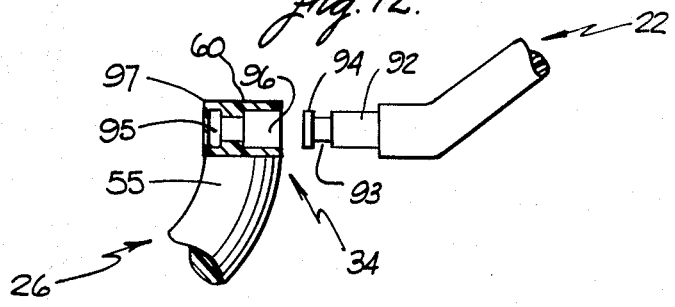
FIG. 12 is an enlarged partial cross-sectional view of a presently preferred embodiment of the swivel portion.

The swivel connecting means 36 comprises a hub portion 60 on the uppermost connecting portion 55 having a central vertically extended bore 60A. In the embodiment of FIG. 10, the lower end portion 46 of support means 22 has a central bore 61 which terminates in an enlarged counter bore 62 to provide an abutment shoulder 63. A connecting pin member 66 made of one piece of molded plastic material has a cylindrical head portion 68, a cylindrical pin portion 70 and a slotted upper end portion 72 with a central slot 74 between resiliently deflectable flange portions 76, 78 having lip portions 80, 82 which are axially slidably insertable into counter bore 62 to rotatably connect the attachment means 22 to the hanger means 26. In the embodiment of FIG. 11, the swivel means comprises a reduced diameter pin portion 84 on attachment means 22 with resilient deflectable flange portions 86, 87 separated by a slot 88 to enable lip portions 89, 90 to be inserted through bore 60A. In the embodiment of FIG. 12, the swivel means comprises a reduced diameter pin portion 92 having an annular slot 93 adjacent an annular head portion 94 which is received in an annular end portion 95 of a bore 96 in hub portion 97 of the hanger means 26 by resilient deflection during assembly. In each embodiment, the hanger means is rotatable relative to the support means after assembly.

Thus, various articles of accessories, clothing or jewelry or the like can be hung on the various hook portions in an accessible convenient and viewable manner. The construction and arrangement is such as to enable very low cost manufacture and production of a very light weight yet durable device comprising only two or three parts which can have a variety of colors. The hanger means has a central vertically extending longitudinal axis 27 with the hook means portions equally laterally spaced therealong. The hook portions and the connection portions have opposite generally parallel spaced side surface portions 36, 37 located in coplanar relationship along a first pair of parallel spaced vertical planes and generally parallel spaced edge surface portions 38, 39 located in coplanar relationship along a second pair of spaced vertical planes which are transverse to the first pair of parallel spaced vertical planes whereby the first pair of parallel spaced vertical planes and the second pair of parallel spaced vertical planes define a vertical parallel piped configuration therebetween.

Each of the hook portions has a central generally circular opening having a central axis of curvature 50A and the central axes of curvature of the circular openings are coplanar and located along the central longitudinal axis 27 of the hanging means. Each of the hook portions comprises a lowermost generally semi-cylindrical intermediate section; an upwardly extending connecting portion connected to one side of the intermediate section and having an uppermost terminal portion connected to a hook portion thereabove; and an upwardly extending end portion connected to the other side of the intermediate section and terminating in an upwardly spaced uppermost terminal portion spaced from the connecting portion to define an access slot therebetween. The swivel means has a vertical axis of rotation 48 which is coaxial with the central longitudinal axis 27 of the hanger means and the axis 49 of the hanger opening 42 is located along the central longitudinal axis 27. While the present preferred embodiment employes one-piece plastic molded parts, the parts may be made of other material such as metal.

The inventive concepts disclosed herein may be variously employed and modified to provide the advantages of the present invention. It is intended that the appended claims be construed to include modifications and variations of the invention except insofar as limited by the prior art.

The invention claimed is as follows:

1. Apparatus for hanging articles of clothing or the like in a clothes closet or the like by suspension from a hanger rod or the like comprising:

an elongated vertically extending article hanging means having a plurality of vertically spaced oppositely facing hook means portions and being made of one piece of material for supporting the articles of clothing or the like and having a central vertical longitudinal axis;

a support means made of one piece of material and having a hook portion for mounting on a hanger rod or the like;

swivel connecting means having a central vertical axis of rotation which is coaxial with said central vertical longitudinal axis for rotatably connecting said elongated vertically extending article hanging means to said support means and each of said oppositely facing hook means portions having a central generally circular opening having a central axis of curvature and the central axes of curvature of the circular openings being transverse to said central vertical longitudinal axis and the circular openings being generally coplanar with and located substantially along said central vertical longitudinal axis.

2. The invention as defined in claim 1 and wherein:

said article hanging means having an uppermost hook means portion, a lowermost hook means portion, a plurality of intermediate hook means portions between said upper hook means portion and said lower hook means portion, and integral connecting portions therebetween.

3. The invention as defined in claim 2 and wherein:

said hook means portions and said connection portions having opposite generally parallel spaced side surface portions located in equally oppositely spaced relationship to said central vertical longitudinal axis in coplanar relationship along a first pair of parallel spaced vertical planes and generally parallel spaced edge surface portions located in equally oppositely spaced relationship to said central vertical longitudinal axis in coplanar relationship along a second pair of spaced vertical planes which are transverse to said first pair of parallel spaced vertical planes whereby said first pair of parallel spaced vertical planes and said second pair of parallel spaced vertical planes define a vertical parallel piped configuration therebetween.

4. The invention as defined in claim 2 and wherein:

each of said hook means portions comprising a lowermost generally semi-cylindrical intermediate portion;

an upwardly extending connecting portion connected to one side of said intermediate portion and having an uppermost portion integrally connected to a hook means portion thereabove; and an upwardly extending end portion connected to the other side of said intermediate portion and terminating in an upwardly spaced uppermost terminal end portion spaced from said connecting portion to define an access slot therebetween.

5. The invention as defined in claim 4, and wherein said connecting portion of each of said hook means portions below said uppermost hook portion having a generally triangular-shape peripheral configuration.

6. The invention as defined in claim 5 and wherein each connecting portion comprising a pair of spaced vertically upwardly extending generally cylindrical side wall portions connected to opposite ends of said intermediate portion.

7. The invention as defined in claim 6 and wherein each connecting portion further comprising a web portion extending between and connecting said intermediate portion and said pair of spaced vertically upwardly extending generally cylindrical side wall portions.

8. The invention as defined in claims 2 or 7 and said swivel connecting means comprising:

an elongated vertically extending hub portion having a central bore and located on and being integrally formed with and as a part of said uppermost hook means portion of said article hanging means;

a connecting pin means connectively associated with said support means and said article hanging means and being mounted in said central bore in said hub portion for enabling rotation of said article hanging means relative to said support means; and resilient deflectable flange means being integrally formed with and as part of one of said connecting pin means and said hub portion for enabling connection of said support means and said article hanging means by axial sliding movement of said connecting pin means in said central bore of said hub portion to a connecting position by resilient deflection and subsequent expansion of said flange means.

9. The invention as defined in claim 8 and wherein:

said hub portion having a cylindrical outer peripheral configuration and a generally cylindrical central bore coaxial with said central vertical longitudinal axis; and said connecting pin means being on the lower end portion of and integral with said support means.

10. The invention as defined in claim 9 and wherein:

said resilient flange means being located on said connecting pin means; and said connecting pin means being mounted in and extending completely through said central bore in said hub portion.

11. The invention as defined in claim 9 and wherein:

said resilient flange means being located in said central bore in said hub portion.

* * * * *